US005432985A

United States Patent [19]

Bernart

[11] Patent Number: 5,432,985

[45] Date of Patent: Jul. 18, 1995

[54] SPLITTER PLATE

[75] Inventor: Francis Bernart, Homeworth, Ohio

[73] Assignee: Century Products Company, Macedonia, Ohio

[21] Appl. No.: 130,220

[22] Filed: Oct. 1, 1993

[51] Int. Cl.[6] ..... A44B 11/04

[52] U.S. Cl. ..... 24/265 AL; 24/200; 24/315

[58] Field of Search ..... 24/198, 200, 197, 265 BC, 24/265 R, 265 AL, 315, 307, 308; 2/336, 340; 297/484, 467

[56] References Cited

U.S. PATENT DOCUMENTS

| | | | |
|---|---|---|---|
| D. 285,383 | 9/1986 | Anthony . | |
| 2,212,862 | 8/1940 | Hirsh . | |
| 2,353,378 | 7/1944 | White | 20/340 |
| 2,595,139 | 4/1952 | Hart | 24/200 X |
| 5,177,837 | 1/1993 | Rekuc | 24/200 X |

FOREIGN PATENT DOCUMENTS

| | | | |
|---|---|---|---|
| 465033 | 1/1992 | European Pat. Off. | 24/200 |
| 661885 | 7/1929 | France | 24/198 |

*Primary Examiner*—James R. Brittain
*Attorney, Agent, or Firm*—Graham & James

[57] ABSTRACT

An improved splitter plate arrangement for use with children's furniture such as automobile safety seats and the like comprises a quadrilateral shape having a generally trapezoidal configuration, with the lower edge and side edges disposed in generally orthogonal relationship. A closed slot is disposed parallel to the lower edge and spaced apart therefrom, to receive therethrough the lower belt of a three-point harness extending from the seat. The lower belt is generally looped through and secured in permanent fashion to the closed slot, so that the splitter plate is assembled to the upper end of the lower belt of the three-point harness arrangement. A single upper slot to receive both shoulder belts of the three-point harness is disposed generally parallel to and spaced vertically above the closed slot. The conjunction of both shoulder belts in a single slot determines that the tensile forces applied by the shoulder belts are coincident at a common point at the splitter plate, and are convergent with respect to the lower belt attachment. A single access slot extends from a side edge of the splitter plate to the upper slot. The access slot is narrower in width than the upper slot, and is provided with a dogleg configuration to intersect with a medial-end portion of the upper slot. The closed slot and the upper slot may be positioned eccentrically with respect to the side edges of the splitter plate, and the access slot extends from the more closely adjacent side edge of the plate.

11 Claims, 1 Drawing Sheet

SPLITTER PLATE

BACKGROUND OF THE INVENTION

This invention generally relates to a plate or buckle for joining a plurality of straps, and more particularly to a splitter plate for releasably securing the straps or belts of a seat for babies, toddlers, and children.

There are known in the prior art many forms of child safety seats for automobile use. Generally speaking, many of these devices employ a three-point harness, in which two shoulder belts are joined to a lower belt extending from the seat between the legs of the child. A buckle, known in the art as a splitter plate, is generally employed to releasably secure the two shoulder belts to the lower belt, so that the child may be secured to the safety seat.

A typical splitter plate known in the prior art includes a lower closed slot for securing the lower belt in permanent fashion. A pair of shoulder belt slots are spaced vertically above and laterally with respect to the lower slot, each shoulder belt slot receiving one of the shoulder belts in removable fashion. Each shoulder belt slot includes an opening to the outer edge of the splitter plate, so that the shoulder belts may be inserted into or removed from their respective slots. These openings are oriented generally transversely to their respective slots and spaced adjacent to the end portion thereof, so that the inherent stiffness and form-retaining nature of the belts prevent spontaneous release of the belts from their respective slots. However, the shoulder belts may easily be manipulated to slip out of the openings to release or adjust the belt arrangement.

Equalized tension on the shoulder belts and the lower belt creates a dynamic equilibrium in which the splitter plate is properly oriented with respect to the belt arrangement. However, if the tension applied to the two shoulder belts is unequal, the splitter plate can become canted, due to the fact that the two shoulder belt slots are spaced laterally with respect to the lower slot and with the center of the splitter plate. This situation can be deleterious to the proper functioning of the seat belt assembly. Moreover, the provision of laterally spaced belt slots prevents the prior art splitter plate from being adapted for use in belt assemblies in which only one belt is joined by the splitter plate to the lower belt in the closed slot.

SUMMARY OF THE INVENTION

The invention comprises a unique splitter plate arrangement for use with children's furniture such as automobile safety seats and the like. The splitter plate comprises a quadrilateral shape having a generally trapezoidal configuration, with the lower edge and side edges disposed in generally orthogonal relationship. A closed slot is disposed parallel to the lower edge and spaced apart therefrom, to receive therethrough the lower belt of a three-point harness extending from the seat. The lower belt is generally looped through and secured in permanent fashion to the closed slot, so that the splitter plate is assembled to the upper end of the lower belt of the three-point harness arrangement.

The splitter plate further includes a single upper slot to receive both shoulder belts of the three-point harness. The upper slot is disposed generally parallel to and spaced vertically above the closed slot. The upper slot is generally similar in length and greater in width than the closed slot to provide sufficient clearance for the thickness of both of the shoulder belts. The conjunction of both shoulder belts in a single slot determines that the tensile forces applied by the shoulder belts are coincident at a common point at the splitter plate, and are more coaxial with respect to the lower belt attachment.

A single access slot extends from a side edge of the splitter plate to the upper slot. The access slot is narrower in width than the upper slot, and is provided with a dogleg configuration to intersect with a medial-end portion of the upper slot. The dogleg portion and intersection with the upper slot are provided with smooth radial conjunctions to ease insertion and removal of the belts through the access slot.

The closed slot and the upper slot may be positioned eccentrically with respect to the side edges of the splitter plate, and the access slot extends from the more closely adjacent side edge of the plate. The wider portion of the plate between the ends of the lower slot and upper slot and the further adjacent side edge provides sufficient strength for automobile safety purposes, as does the additional plate mass defined by the upper oblique edge of the splitter plate.

The splitter plate of the invention may be fabricated from sheet metal or the like in a simple stamping operation, resulting in an optimized combination of improved function at the lowest possible cost.

DESCRIPTION OF THE PREFERRED EMBODIMENT

The invention generally comprises an improved buckle or splitter plate for joining a plurality of belts or straps in a safety harness arrangement. Although the invention will be described in connection with its use as a joining member in a three-point harness, the invention may be used in any situation requiring joining of at least two belts or straps.

Figure 1:
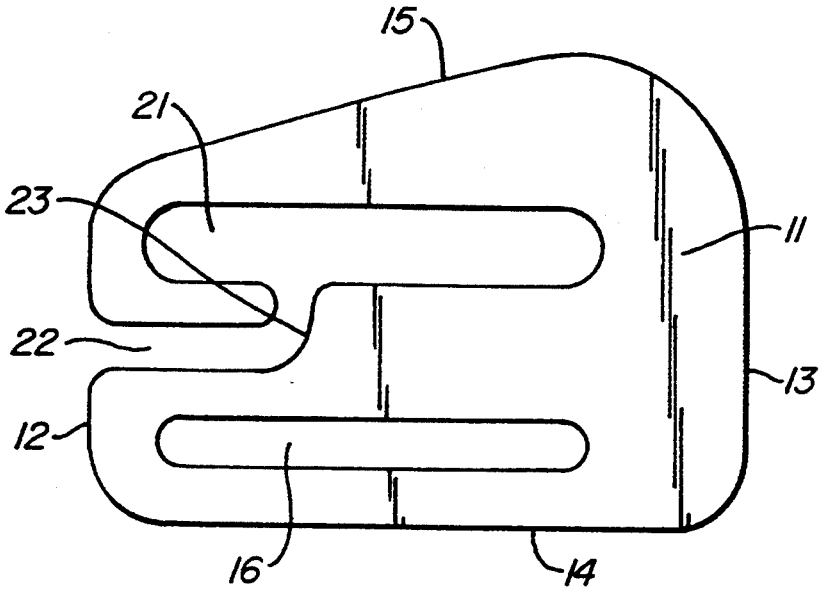
FIG. 1 is a plan view of the splitter plate of the present invention.

With regard to FIG. 1, the splitter plate of the invention comprises a planar member 11 having opposed parallel sides 12 and 13, a lower edge 14 extending generally orthogonally to the sides 12 and 13, and an upper oblique edge 15. The sides 12–15 generally define a trapezoidal configuration having rounded vertices. A closed slot 16 is disposed parallel to the lower edge 14 and spaced apart therefrom, and disposed to receive a belt or strap therethrough. The length of slot 16 is substantially greater than its width, and the opposed end portions of slot 16 am fully radiused to provide a smooth opening with no edges or corners to fray or wear the belt passing therethrough.

The splitter plate further includes a single upper slot 21 disposed generally parallel to and spaced vertically from the closed slot. The upper slot 21 is generally similar in length and greater in width than the closed slot 16 to provide sufficient clearance for more than one belt or strap. The opposed end portions of slot 21 are also fully radiused to provide a smooth opening that minimizes wear on the belt passing therethrough.

The slots 16 and 21 are disposed eccentrically with respect to the side edges of the plate 11; i.e., the two slots are disposed closer to the edge 12. The wider portion of the plate between the ends of the slot s 16 and 21 and the further adjacent side edge provides increased strength in the conjunction of belts secured to the splitter plate. A single access slot 22 extends from the edge 12 of the splitter plate to the upper slot 21. The access slot 22 is narrower in width than the upper slot 21, and is generally parallel to the slot 21. The inner end of the slot 22 is provided with a dogleg configuration 23 which opens into a medial-end portion of the upper slot 22. The dogleg portion and the intersection with the upper slot are provided with smoothly blended conjunctions to ease insertion and removal of the belts through the access slot.

Figure 2:
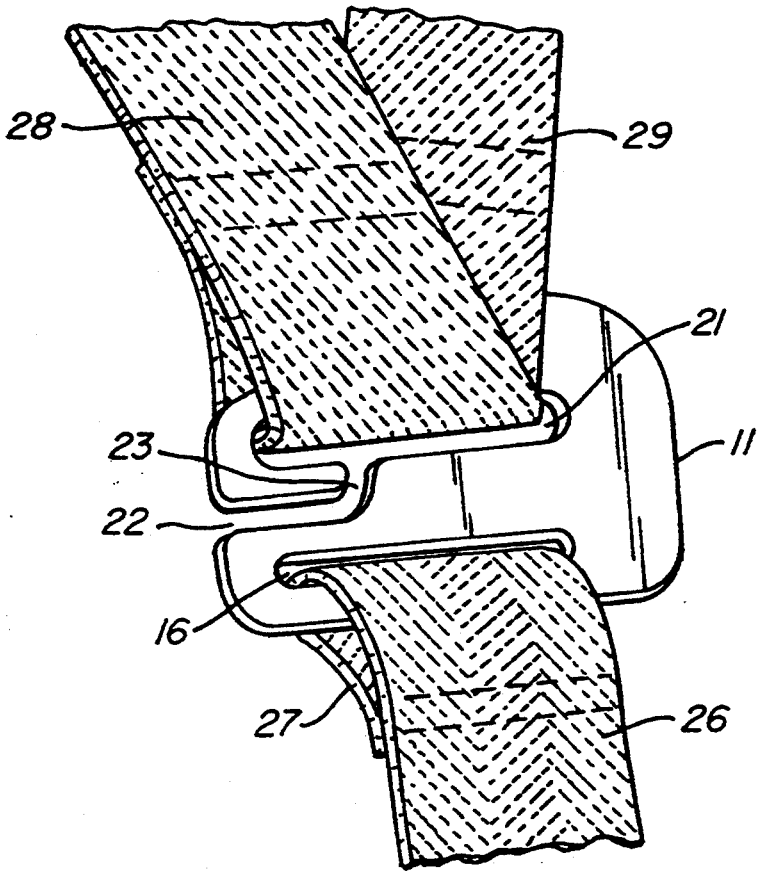
FIG. 2 is a perspective view of the splitter plate depicted in FIG. 1, shown assembled in a three-point harness arrangement.

A preferred use of the splitter plate 11 is depicted in FIG. 2, although other uses may be apparent to those skilled in the art. A belt or strap 26 is passed through the closed slot 16 and joined in a loop 27 to secure permanently the splitter plate 11 to the upper end of the belt 26. The belt 26 may comprise the lower strap of a three-point harness arrangement typically employed in an automobile safety seat for babies an children. A pair of upper belts 28 and 29, which comprise the upper two straps of the three-point harness, are provided with loops formed on the lower ends thereof. The loops may be secured to the splitter plate 11 by sliding the loops into the access slot 22, through the dogleg section 23, and into the slot 21. The intrinsic stiffness of the looped belt material prevents spontaneous or accidental release of the loops through the access slot 22, although minimal manual effort is required to removed the looped belts from the slot 21 when desired.

The convergence of both belts 28 and 29 in the single slot 21 determines that the tensile forces applied by the belts are coincident at a common point at the splitter plate which is generally collinear with respect to the lower belt 26 This arrangement has greater dynamic stability than prior art designs, particularly when the tension on the belts 28 and 29 is unequal or otherwise poorly adjusted. Moreover, if a belt arrangement requires one belt be secured in the slot 21, the forces on the upper and lower belts will be generally collinear and balanced.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. In a three-point safety harness, a splitter plate for joining a plurality of belts, comprising:

a generally planar member forming a splitter plate of sufficient strength to form part of a safety harness;

a first slot formed in said planar member, said first slot having a continuous closed peripheral edge;

a single second slot formed in said planar member, said second slot having an access slot;

said first and second slots disposed in a generally parallel, spaced apart configuration;

said access slot means extending from an outer peripheral edge portion of said planar member to said second slot to permit introduction into and removal of at least one belt in said second slot;

a first belt having one end passed through said first slot in loop fashion and secured permanently to said first belt, wherein said first belt is permanently joined to said planar member;

second and third belts, each having loops formed at adjacent ends and received by said second slot, said loops being variably positionable to be passed through said access slot means and secured in said second slot;

said first, second and third belts forming a substantially "Y"-shaped configuration with respect to one another as part of a three-point safety harness of the kind used in automobiles.

2. The device of claim 1, wherein said first and second slots are generally similar in length and said second slot is greater in width.

3. The device of claim 1, whereto said access slot means is disposed intermediate of said first and second slots.

4. The device of claim 3, wherein said access slot means includes a linear slot portion extending from said outer peripheral edge portion generally parallel to said first and second slots.

5. The device of claim 4, wherein said access slot means further includes a dogleg portion extending from said linear slot portion to a medial portion of said second slot.

6. The device of claim 5, wherein said linear slot portion and said dogleg portion and said second slot include continuous, smoothly contoured joining edge portions disposed therebetween.

7. The device of claim 6, wherein said first and second slots each include opposed ends that are smoothly contoured and rounded.

8. The device of claim 1, wherein said planar member includes opposed side edges extending parallel and spaced apart, a lower edge extending generally orthogonally between said side edges, and an oblique upper edge, said edges defining a trapezoidal configuration.

9. The device of claim 8, wherein said first and second slots are eccentrically disposed closer to one of said side edges.

10. The device of claim 9, wherein said access slot means includes an access slot extending from said one of said side edges to said second slot.

11. A three-point belt assembly of the kind used in automobiles, comprising:

a generally planar member forming a splitter plate for a three-point safety harness of the kind used in automobiles, said splitter plate of sufficient strength to form part of said safety harness;

a first slot formed in said planar member, said first slot having a continuous closed peripheral edge;

a first belt having one end passed through said first slot in loop fashion and secured permanently to said first belt, whereby said first belt is permanently joined to said planar member;

a single second slot formed in said planar member;

said first and second slots disposed in a generally parallel, spaced apart configuration;

access slot means extending from an outer peripheral edge portion of said planar member to said second slot;

second and third belts, each having loops formed at adjacent ends and received by said second slot, said loops being variably positionable to be passed through said access slot means to be free of said planar member;

said first, second and third belts forming part of said three-point safety harness, said second and third belts disposed at different angles to the disposition of said first belt, to form a substantially "Y" shape with respect to the disposition of said first belt.

* * * * *